US005153545A

United States Patent [19]

Ferullo et al. .

[11] Patent Number: 5,153,545

[45] Date of Patent: Oct. 6, 1992

[54] MOLDED CASE CIRCUIT BREAKER ARC BAFFLE INSERT

[75] Inventors: David A. Ferullo, Plainville; David Arnold, Chester, both of Conn.

[73] Assignee: General Electric Company, New York, N.Y.

[21] Appl. No.: 772,407

[22] Filed: Oct. 7, 1991

[51] Int. Cl.[5] ..... H01H 9/30

[52] U.S. Cl. ..... 335/201; 200/144 R

[58] Field of Search ..... 200/147 R; 335/201, 335/202, 144 R

[56] References Cited

U.S. PATENT DOCUMENTS 3,043,939 7/1962 Gryctko et al. .
4,019,005 4/1977 Michetti .
4,281,303 7/1981 Heft .
4,581,511 4/1986 Leone ..... 200/144 R
4,631,376 12/1986 Leone ..... 200/144 R
4,963,849 10/1990 Kowalczyk et al. .
4,982,174 1/1991 Fasano ..... 335/201

*Primary Examiner*—Lincoln Donovan
*Attorney, Agent, or Firm*—Richard A. Menelly

[57] ABSTRACT

A refractory fiber insert within the cover of a molded case circuit breaker interfaces between the interior of the circuit breaker cover and the top surface of the circuit breaker arc chute to prevent the arc by-products generated within the arc chamber from re-entering the arc chamber. A shaped slot formed within the fiber insert automatically compensates for manufacturing tolerances to precisely locate the insert between the cover interior and the top surface of the arc chute.

9 Claims, 4 Drawing Sheets

MOLDED CASE CIRCUIT BREAKER ARC BAFFLE INSERT

BACKGROUND OF THE INVENTION

U.S. Pat. No. 4,281,303 describes a molded case circuit breaker having an early arc chute design whereby the arc gases generated upon separation of the circuit breaker contacts under heavy overload conditions is directed out the line end of the circuit breaker enclosure.

An earlier U.S. Patent, namely, U.S. Pat. No. 3,043,939 describes the operation of a 3-pole molded case circuit breaker wherein the arc gas generated within the center pole is vented from the line side of the circuit breaker and the arc gases generated by separation of the remaining two poles is vented out the load side of the circuit breaker enclosure. This is to prevent the intermixing of the arc gases generated from the separate poles and to thereby prevent the occurrence of a "phase-to-phase" fault caused by the electrical conductivity of the highly ionized exhaust gases.

A later attempt to prevent the phase-to-phase fault occurrence in molded case circuit breakers is described in U.S. Pat. No. 4,019,005. The baffle used between the vented opening of the circuit breaker enclosure and the circuit breaker arc chute is designed to direct the arc gases in preferred directions to the exterior of the circuit breaker enclosure to thereby prevent any intermixing between the ionized gases originating from the separate poles.

The advanced state-of-the-art of the circuit breaker arc chutes used within current limiting type circuit breakers, wherein large quantities of arc gases are generated, is found within U.S. Pat. No. 4,963,849. This Patent describes a compact integrated arc chute that interfaces between the interior surface of the circuit breaker cover and the bottom of the circuit breaker case to efficiently direct the arc exhaust gases out from the circuit breaker enclosure.

When the ampere rating of the circuit breaker described within the aforementioned U.S. Pat. No. 4,281,303 was increased it was then determined that the gaseous by-products resulting from the arc that occurs upon contact separation includes vaporized metals that could return and re-deposit upon the circuit breaker contacts. It would be desirable, to increase the ampere rating of such circuit breakers without requiring a corresponding major redesign of the associated circuit breaker arc chutes and arc chambers.

Accordingly, the instant invention provides a simple and economically feasible adaptation to existing circuit breaker arc chambers to prevent vaporized metal products within the arc from re-depositing upon the circuit breaker contacts.

SUMMARY OF THE INVENTION

A pentangular refractory fiber insert is positioned within the circuit breaker cover between the interior surface of the circuit breaker cover and the top surface of the circuit breaker arc chute within the arc chamber. The insert includes a triangular slot to compensate for manufacturing tolerances between the circuit breaker cover and the arc chute. The insert thereby hermetically seals the arc chamber and prevents the exiting arc exhaust gases from returning to the arc chamber.

DESCRIPTION OF THE PREFERRED EMBODIMENT

Figure 1:
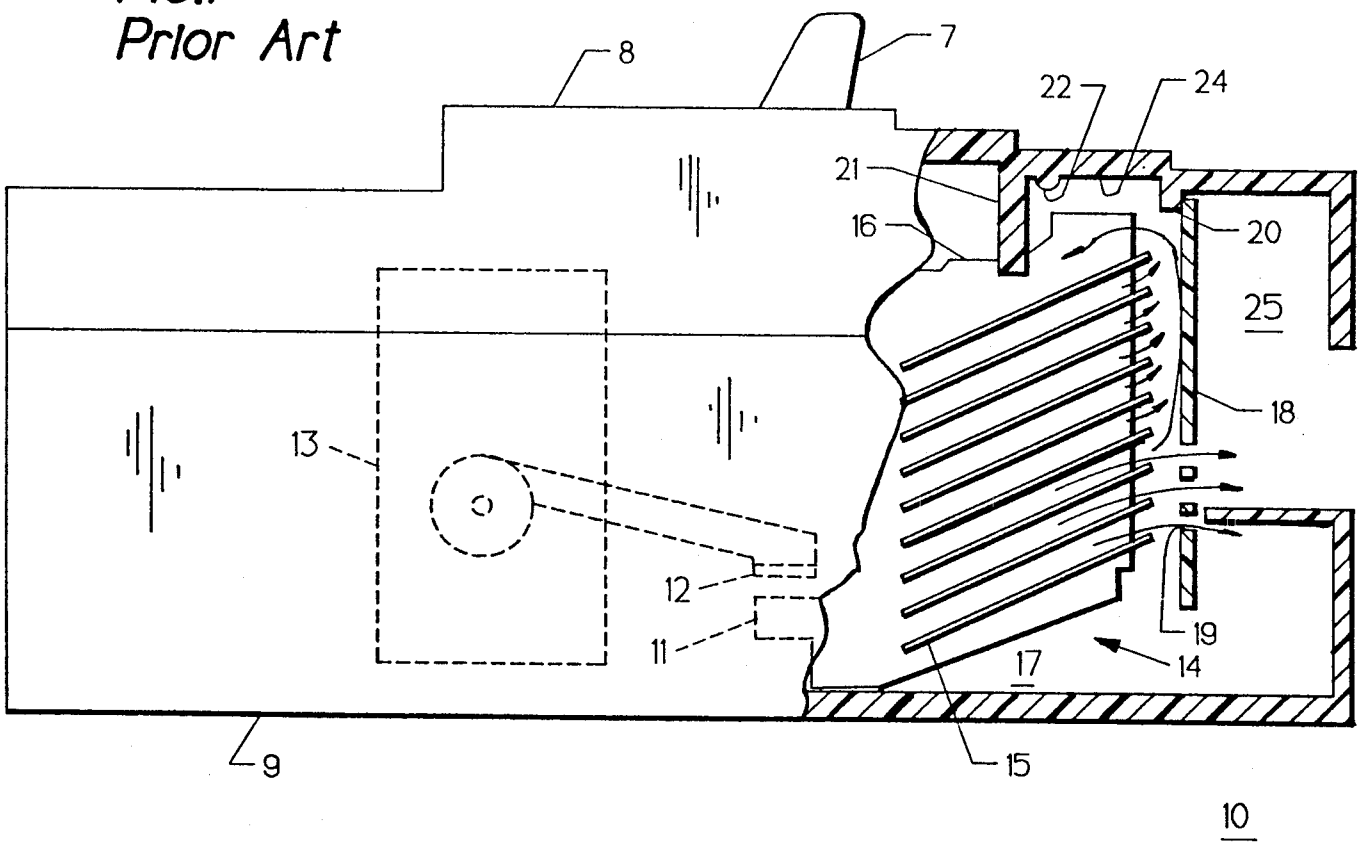
FIG.1 Prior Art
FIG. 1 is a side view of a circuit breaker arc chute arrangement in accordance with the prior art.

In order to clearly understand the teachings of the instant invention, it is helpful to review the operation of a molded case circuit breaker in accordance with the state-of-the-art of current limiting circuit interruption technology. One such molded case current limiting circuit breaker 10 is shown in FIG. 1 and consists of a molded plastic cover 8 through which an operating handle 7 extends and which is securely attached to a molded plastic circuit breaker case 9. A movable contact 12 controlled by an operating mechanism 13 becomes separated from a fixed contact 11 upon the occurrence of an overcurrent condition of predetermined magnitude and time duration. In order to cool and deionize the arc that occurs upon such contact separation, an arc chute 14 consisting of a plurality of metal arc plates 15 arranged on an insulative side frame 16 is positioned adjacent to the circuit breaker contacts within the arc chamber 17, as indicated. One of the side plates is removed in order to more clearly show the direction of transport of the exhaust arc gases as indicated by arrows. A baffle plate 18 interposed between the arc chamber 17 and the lug chamber 25 is stopped against a projection 20 integrally-formed with the interior surface 24 of the cover. Slotted vents 19 within the baffle provide for the egress of the exhausting gases out from the arc chamber to the exterior of the circuit breaker enclosure. Formations 21 extending downward from the interior surface of the cover along with projections 22 also integrally-formed on the interior surface of the cover deter the transfer of arc gases back into the arc chamber, to some extent. As described earlier, however, when the circuit breaker is operated at increased ampere rating, the arc gases generated are of sufficient intensity to flow back beneath the projections 21 into the vicinity of the circuit breaker contacts 11, 12. The presence of the vaporized metals contained within the arc gases could alloy with and alter the composition of the refractory metal contacts.

Figure 2:
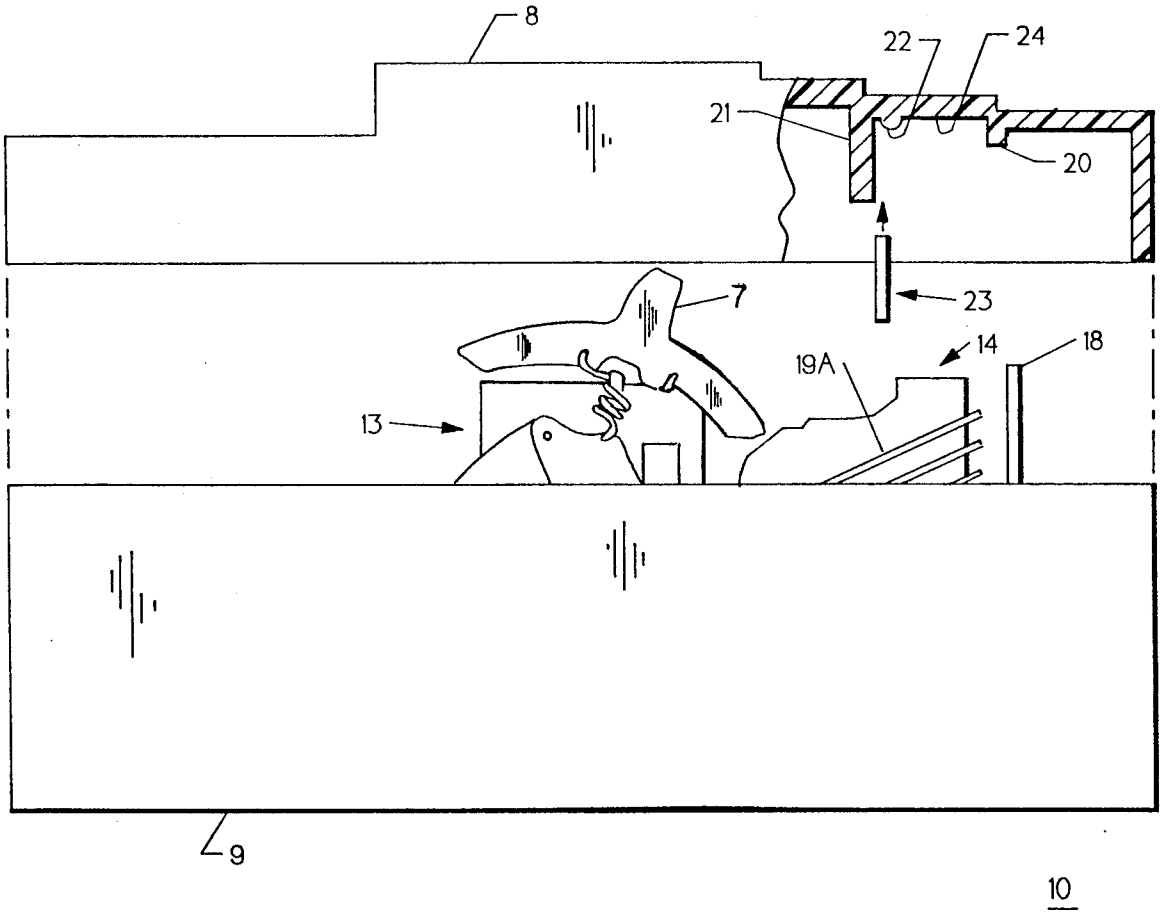
FIG. 2 is a side view of the circuit breaker case and cover prior to insertion of the refractory fiber insert in accordance with the invention.

To prevent the arc gases from returning to the circuit breaker interior, the circuit breaker 10 depicted in FIG. 2 includes a refractory fiber insert 23 that is positioned in a press-fit relation between the projections 22, 21 integrally-formed on the interior surface 24 of the cover 8. When the cover 8 is later secured to the circuit breaker case 9, the handle 7 projects through an aperture (not shown) formed within the cover and the operating mechanism 13 contacts the interior surface of the circuit breaker cover and is held down by the cover when the cover is later secured to the case. The top of the baffle 18 contacts the associated projection 20 formed on the interior surface of the circuit breaker cover as described earlier. The bottom of the insert 23 contacts the topmost arc plate 19A within the arc chute 14.

Figure 3:
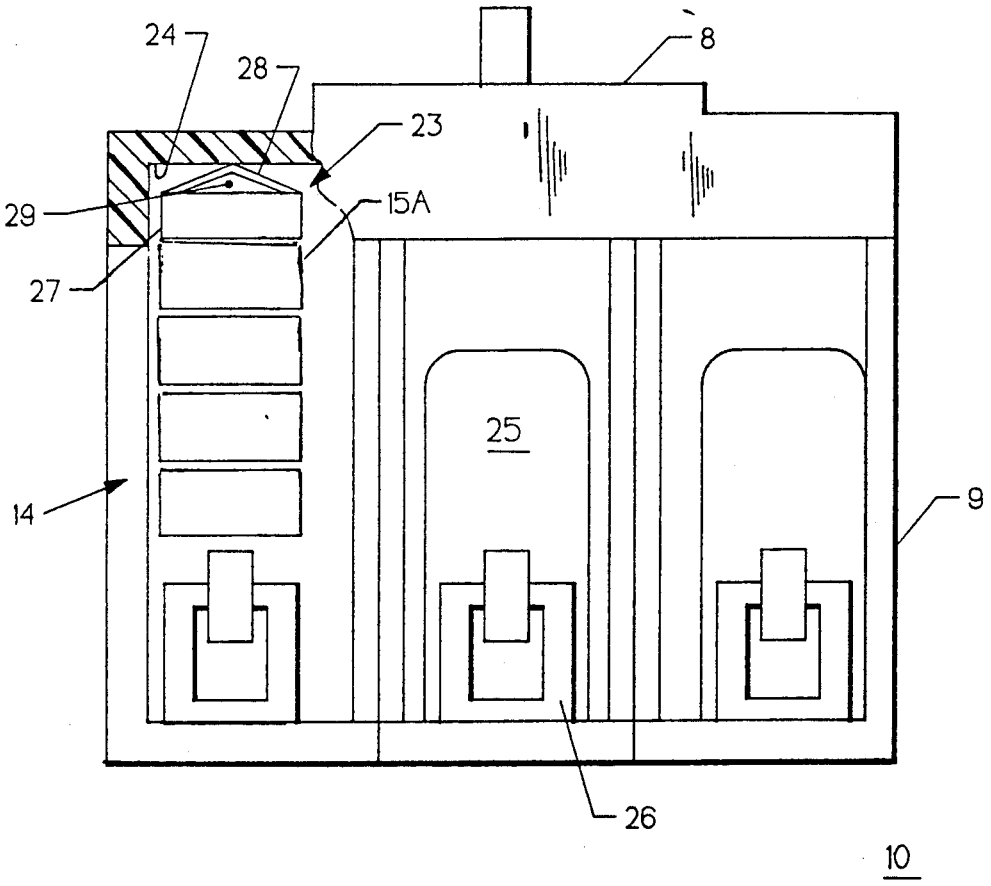
FIG. 3 is an end view of the circuit breaker of FIG. 2 with a part of the circuit breaker case and cover removed to depict the refractory fiber insert in accordance with the invention.

Referring now to FIG. 3, the circuit breaker 10 is depicted with the cover 8 securely attached to the case 9 and with the top 28 of the refractory fiber insert 23 against the bottom surface 24 of the cover. The bottom 27 of the refractory insert stops against the topmost arc plate 15A within the arc chute 14. The refractory fiber insert is of a pentagonal shape defined by the rectangular bottom 27 and the triangular top 28. The triangular shaped clearance slot 29 formed within the top cooperates with the top and becomes compressed when the cover 8 is later secured to the case 9. The provision of the triangular clearance slot allows for manufacturing tolerances which occur between the arc chute 14 and the cover. This is an important part of the invention since the absence of such a tolerance compensating slot could interfere with attachment between the case and cover due to tolerance accumulation during the assembly of the various circuit breaker components. To clearly depict the arc chute, the interior surface 24 and the topmost arc plate 15A, the baffle 18 shown earlier in FIG. 2 is omitted. The line lugs 26 which provide electrical connection between the circuit breaker and the associated electric power distribution circuit are shown within the lug compartments 25 integrally-formed within the circuit breaker case.

Figure 4:
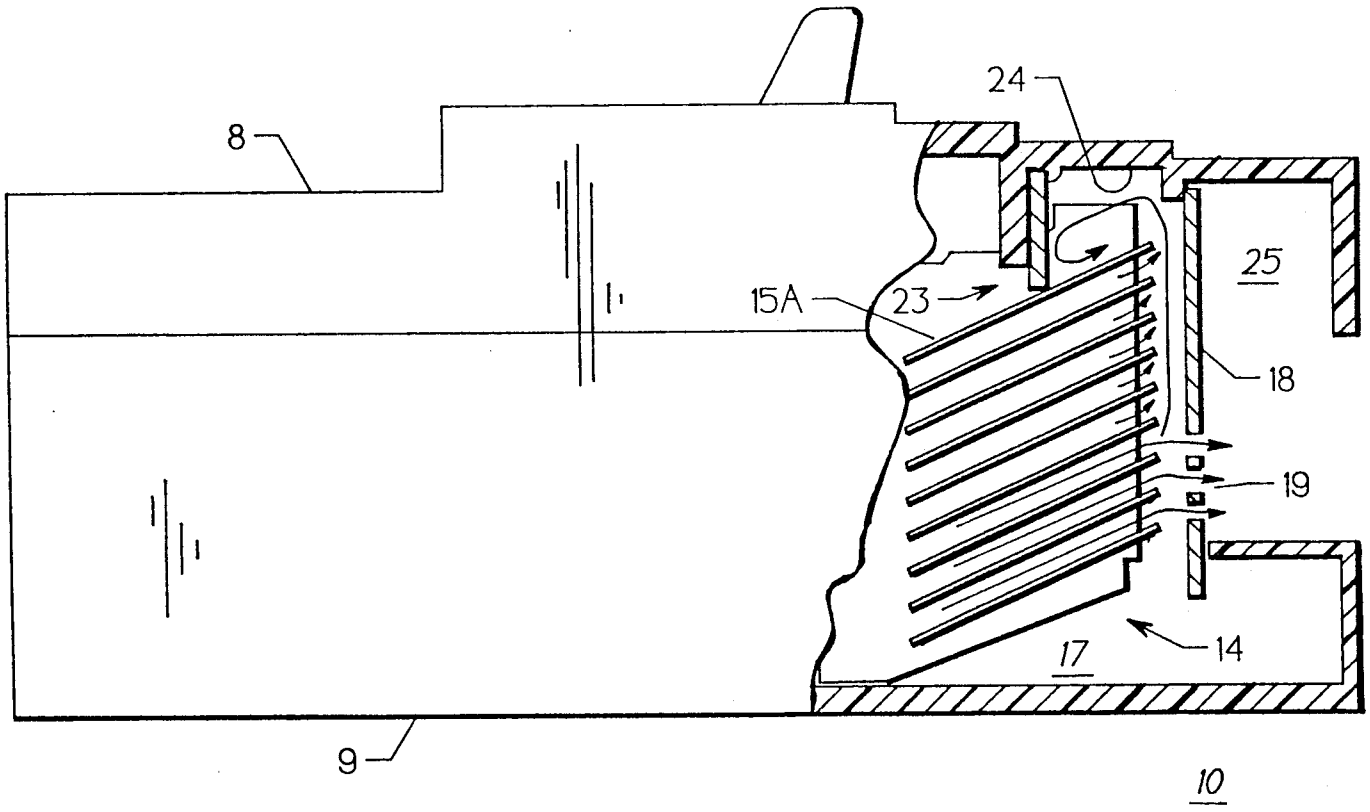
FIG. 4 is a side view of the circuit breaker of FIGS. 2 and 3 with part of the cover and case removed to depict the position of the refractory fiber insert in accordance with the teachings of the invention.

The transfer of the arc gases out from the arc chamber 17 and the interior of the circuit breaker is best seen by referring now to the circuit breaker 10 shown in FIG. 4. With the circuit breaker cover 8 securely fastened to the circuit breaker case 9 the refractory fiber insert 23 butts up against the topmost arc plate 15A and thereby forms a hermetic seal between the arc chute 14 and the bottom interior 24 of the circuit breaker cover. It is noted that the arc gases depicted by the arrows transfer out from the arc chamber 17 to the lug compartment 25 and to the exterior of the circuit breaker enclosure through the slots 19 arranged within the baffle 18. The presence of the refractory fiber insert 23 thereby effectively prevents the return of the ionized gases to the arc chamber and the circuit breaker enclosure.

Having thus described our invention, what we claim as new and desire to secure by Letters Patent is:

1. A molded case circuit breaker comprising in combination:

a case and cover;

an operating mechanism contained within said case and arranged for separating a pair of contacts upon occurrence of an overcurrent condition through a protected circuit;

an arc chute consisting of a plurality of arc plates within said case ahead of said contacts and arranged for cooling and deionizing an arc that occurs between said contacts when said contacts are separated under said overcurrent condition;

an insert interposed between an interior surface of said cover and a top part of said arc chute; said insert substantially forming a hermetic seal between said cover and said arc chute to deter arc gases from returning to said contacts;

an arc baffle interposed between said arc chute and an opening through one end of said case;

a first projection formed on said interior surface; and a second projection formed on said interior surface, said insert being compressed between said first and second projections.

2. The circuit breaker of claim 1 wherein said insert is arranged within said first and second projections in a press-fit relation.

3. The circuit breaker of claim 1 wherein said insert comprises a refractory.

4. The circuit breaker of claim 1 wherein said insert includes tolerance compensation.

5. The circuit breaker of claim 1 wherein said insert comprises a rectangular bottom and a triangular top.

6. The circuit breaker of claim 4 wherein said tolerance compensation comprises a slot.

7. The circuit breaker of claim 1 wherein said insert is positioned between said interior surface of said cover and an uppermost arc plate within said arc chute.

8. The circuit breaker of claim 6 wherein said slot comprises a triangular configuration.

9. The circuit breaker of claim 6 wherein a top of said triangle configuration contacts said interior surface of said cover and a bottom of said triangular configuration contacts said top part of said arc chute.

* * * * *